US010820694B2

(12) United States Patent
Hall et al.

(10) Patent No.: US 10,820,694 B2
(45) Date of Patent: Nov. 3, 2020

(54) RECONFIGURABLE WORKSPACE

(71) Applicants: David R. Hall, Provo, UT (US); Andrew Priddis, Mapleton, UT (US); Joseph Blanch, Provo, UT (US); Eimi Priddis, Mapleton, UT (US); Kevin Cheatham, Provo, UT (US)

(72) Inventors: David R. Hall, Provo, UT (US); Andrew Priddis, Mapleton, UT (US); Joseph Blanch, Provo, UT (US); Eimi Priddis, Mapleton, UT (US); Kevin Cheatham, Provo, UT (US)

(73) Assignee: Hall Labs LLC, Provo, UT (US)

( * ) Notice: Subject to any disclaimer, the term of this patent is extended or adjusted under 35 U.S.C. 154(b) by 8 days.

(21) Appl. No.: 15/334,641

(22) Filed: Oct. 26, 2016

(65) Prior Publication Data

US 2018/0110330 A1 Apr. 26, 2018

(51) Int. Cl.

| | |
|---|---|
| ***A47B 77/08*** | (2006.01) |
| ***A47B 49/00*** | (2006.01) |
| ***A47B 77/06*** | (2006.01) |
| ***A47B 77/02*** | (2006.01) |
| ***A47B 63/06*** | (2006.01) |
| ***A47B 61/06*** | (2006.01) |

(52) U.S. Cl.

CPC ..... *A47B 77/08* (2013.01); *A47B 49/008* (2013.01); *A47B 61/06* (2013.01); *A47B 63/067* (2013.01); *A47B 77/02* (2013.01); *A47B 77/06* (2013.01); *A47B 2220/01* (2013.01); *A47B 2220/03* (2013.01)

(58) Field of Classification Search

CPC ..... A47B 77/08; A47B 95/008; A47B 77/02; A47B 49/008; A47B 77/06

See application file for complete search history.

(56) References Cited

U.S. PATENT DOCUMENTS

| | | | | | |
|---|---|---|---|---|---|
| 786,670 | A * | 4/1905 | Parker | A47B 31/02 | 312/199 |
| 3,915,529 | A * | 10/1975 | Bernier | A47B 3/10 | 126/37 B |
| 4,191,435 | A * | 3/1980 | Lehman | A47B 63/067 | 198/799 |
| 4,360,991 | A * | 11/1982 | West | E04B 2/7416 | 312/286 |
| 4,643,495 | A * | 2/1987 | Pepping | B65G 1/127 | 198/800 |
| 6,053,588 | A * | 4/2000 | Biggel | A47B 21/00 | 312/249.11 |

(Continued)

*Primary Examiner* — Basil S Katcheves
*Assistant Examiner* — Omar F Hijaz

(57) ABSTRACT

The invention is a reconfigurable workspace. The workspace is compact in order to keep components of the workspace within an arm's reach while standing in a fixed location. The workspace is made up of two rectangular housings, preferably of the same compact size and shape. The first housing has at least a sink and a counter space, though it could have other appliances. The second housing has a circulating storage system, preferably an automated storage and retrieval system that delivers items to a convenient access point. The two housings are repositionable in relation to each other along a fixed path. An apparatus such as a hinge or a set of tracks repositions the housings in relation to each other along the fixed path.

18 Claims, 14 Drawing Sheets

(56) References Cited

U.S. PATENT DOCUMENTS

| | | | | |
|---|---|---|---|---|
| 7,722,377 | B2 * | 5/2010 | Moore | H01R 13/6392<br>439/341 |
| 8,303,233 | B2 * | 11/2012 | Solomon | A47B 63/067<br>104/130.07 |
| 8,544,795 | B2 * | 10/2013 | Guering | B64D 11/00<br>244/118.5 |
| 2003/0118428 | A1 * | 6/2003 | McFarland | B65G 1/127<br>414/331.04 |
| 2004/0034924 | A1 * | 2/2004 | Underbrink | A47K 1/02<br>4/619 |
| 2005/0230550 | A1 * | 10/2005 | Dominguez | B64C 1/1469<br>244/129.5 |
| 2005/0236947 | A1 * | 10/2005 | LeClear | A47B 71/00<br>312/404 |
| 2007/0151300 | A1 * | 7/2007 | Sunshine | A47B 46/00<br>68/3 R |
| 2007/0157378 | A1 * | 7/2007 | Kendall | A47B 67/04<br>4/630 |
| 2010/0147197 | A1 * | 6/2010 | Chen | A47B 3/0915<br>108/36 |
| 2013/0293077 | A1 * | 11/2013 | Haemmerle | A47B 88/931<br>312/319.1 |
| 2014/0259378 | A1 * | 9/2014 | Combs | A47K 1/02<br>4/643 |
| 2016/0020562 | A1 * | 1/2016 | Birdwell | H01R 43/26<br>439/529 |

* cited by examiner

RECONFIGURABLE WORKSPACE

CROSS-REFERENCES

Technical Field

This invention relates generally to the field of compact workspaces, and more specifically to reconfigurable compact workspaces.

BACKGROUND

Constructing a green or sustainable building requires optimizing the use of available space, such that all necessary or desired amenities can fit within the smallest possible area. This is challenging when it comes to constructing a kitchen, or a kitchen as part of a broader workspace. Traditional kitchens make space for myriad large appliances—refrigerators, freezers, ovens, stoves, sinks, dishwashers, and microwaves; small appliances—toasters, coffee machines, blenders, and mixers; storage areas—drawers, shelves, cabinets, and cupboards; and counter spaces. These features are combined in many different layouts, but, generally, the resulting configurations cover large areas. Because of the growing need for full kitchen functionality within a limited space, however, numerous compact kitchen configurations have been created in recent years. These current embodiments, apart from optimizing space, also enable kitchens to be easily manufactured in modular form and easily transported or installed in non-traditional spaces, like offices or basements. However, current embodiments lack some desirable features.

First, current compact kitchen models often shrink in size at the expense of some desired features, especially storage space. Second, the kitchens may be so crowded with desired features that there is little room left for traditional working space. Furthermore, though current embodiments may be customizable before installation, after installation, users are helpless to reconfigure the compact kitchen so as to accommodate varying spatial requirements, or, if reconfiguration is possible, functionality is lost because access to some components of the kitchen is rendered impossible.

In light of the foregoing, what is needed is a compact workspace with full kitchen functionality that is able to be quickly and easily reconfigured to accommodate varying spatial requirements without losing functionality.

SUMMARY OF THE INVENTION

The disclosed invention has been developed in response to the present state of the art and, in particular, in response to the problems and needs in the art that have not yet been fully solved by currently available components and methods. Accordingly, efficient structural components and methods have been developed to allow a compact workspace to be quickly and easily reconfigured.

Consistent with the foregoing, a reconfigurable workspace is disclosed. The reconfigurable workspace comprises a first housing comprising a plurality of walls and an interior volume. The interior volume comprises dimensions such that a width and depth are accessible at a standard arm's length. The interior volume further comprises a counter space and a sink. The reconfigurable workspace further comprises a second housing comprising a circulating storage system disposed behind the first housing. The first and second housings are repositionable in relation to each other along a fixed path, the fixed path comprising an apparatus that repositions the first and second housings.

In a preferred embodiment, the first and second housings are identical in shape and size and measure approximately four feet (1.2192 meters) wide and two feet (0.61 meters) deep. In one embodiment, the first housing comprises additional appliances. In some embodiments, the circulating storage system of the second housing is an automated storage and retrieval system that is either a revolving or a non-revolving system, which may comprise additional appliances or electrically conductive wall hooks. In different embodiments, the apparatus is one or more hinges or a set of tracks mounted to one or more walls or to a floor. In different embodiments, the reconfigurable workspace is portable or mounted to a wall. In different embodiments, the sink is removably covered by the counter space, the first housing is reversible, or the utilities and plumbing are provided by flexible piping.

BRIEF DESCRIPTION OF THE DRAWINGS

A more particular description of the invention briefly described above is made below by reference to specific embodiments depicted in drawings included with this application, in which.

DETAILED DESCRIPTION

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

Figure 1:
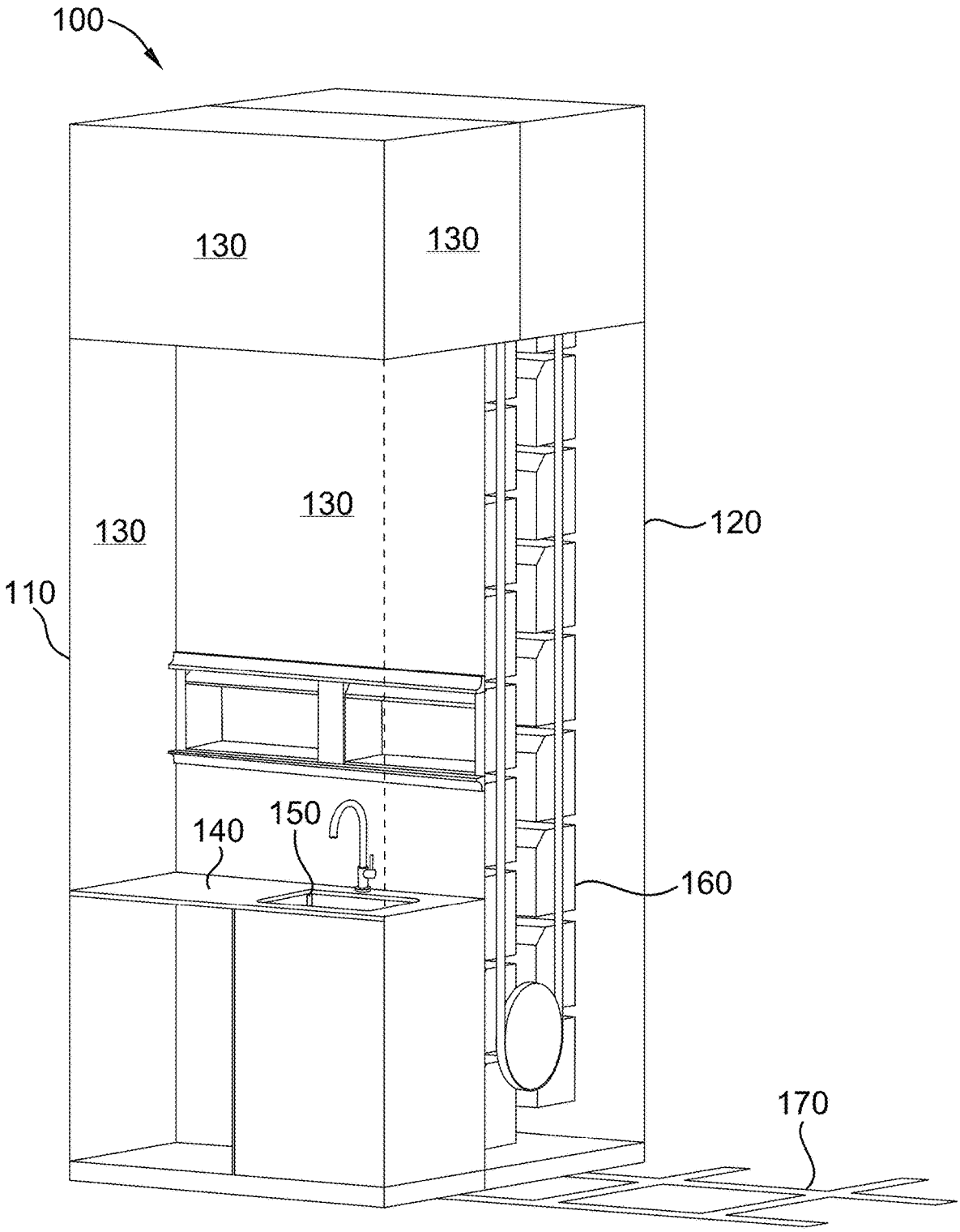
FIG. 1 depicts one embodiment of the reconfigurable workspace.

FIG. 1 depicts one embodiment of the reconfigurable workspace 100. The reconfigurable workspace 100 comprises a first housing 110 comprising a plurality of walls 130 and an interior volume. The interior volume comprises dimensions such that a width and depth are accessible at a standard arm's length. The interior volume further comprises a counter space 140 and a sink 150. The reconfigurable workspace 100 further comprises a second housing 120 comprising a circulating storage system 160 disposed behind the first housing 110. The first housing 110 and the second housing 120 are repositionable in relation to each other along a fixed path. The fixed path comprises an apparatus 170 that repositions the first housing 110 and the second housing 120.

Figure 2:
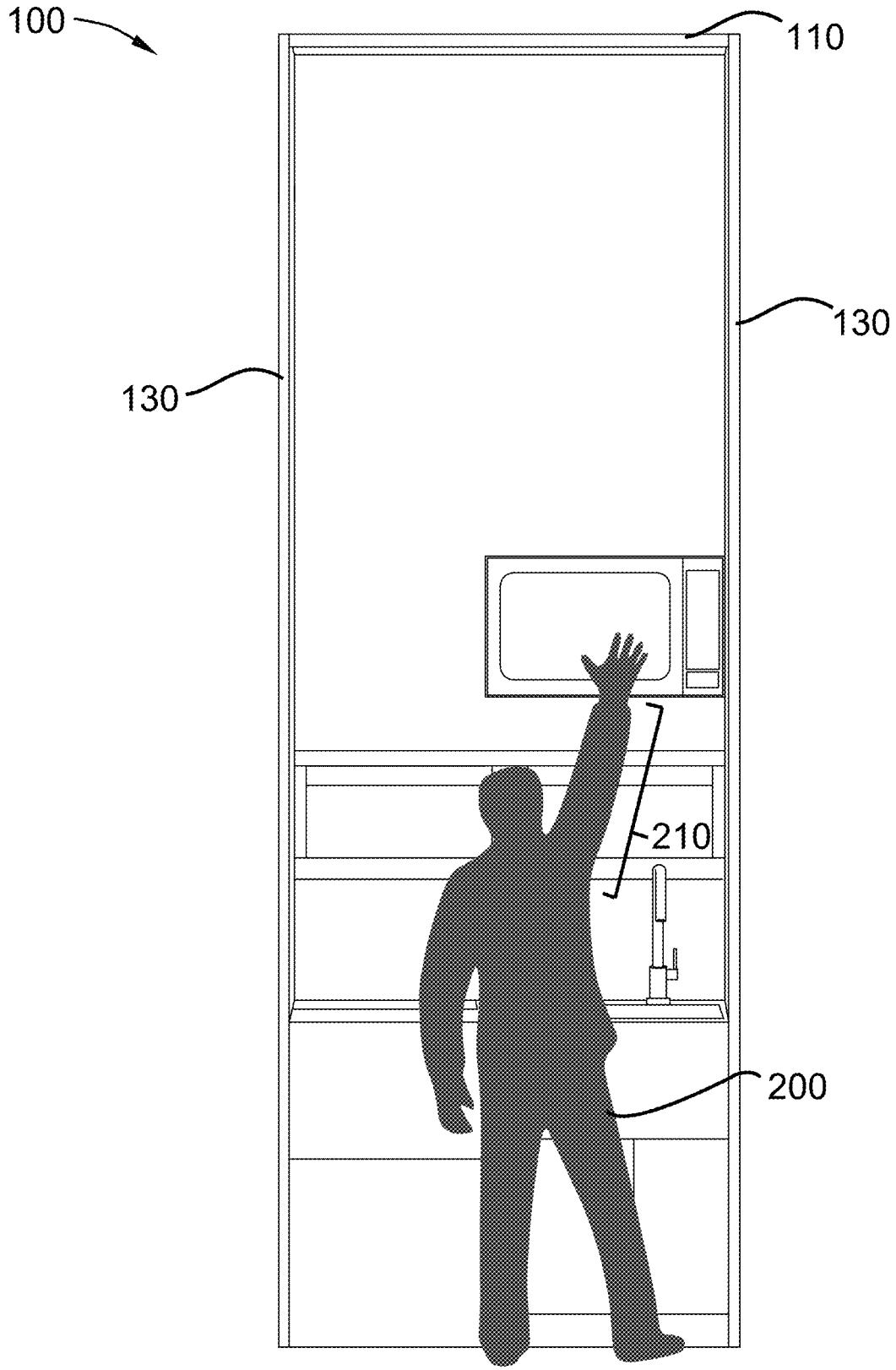
FIG. 2 depicts a front view of one embodiment of the reconfigurable workspace with a user standing in front.

FIG. 2 depicts a front view of one embodiment of the reconfigurable workspace 100 with a user 200 standing in front. The first housing 110 comprises a plurality of walls 130 and an interior volume. The interior volume comprises dimensions such that a width and depth are accessible at a standard arm's length 210. In one embodiment, width and depth dimensions of the first housing 110 measure between approximately two feet (0.61 meters) and six feet (1.22 meters). Preferably, the interior volume of the first housing 110 measures approximately four feet (1.22 meters) wide and two feet (0.61 meters) deep. In one embodiment, width and depth dimensions of the second housing 120 (not seen in the front view of FIG. 2) also measure between approximately two feet (0.61 meters) and six feet (1.22 meters), preferably measuring approximately four feet (1.22 meters) wide and two feet (0.61 meters) deep. In a preferred embodiment, the first housing 110 and the second housing 120 are identical in shape and size. These dimensions are convenient dimensions, such that a user 200 is able to reach all space within the reconfigurable workspace 100, with the exception of vertical space, without moving from one fixed location.

Figure 3:
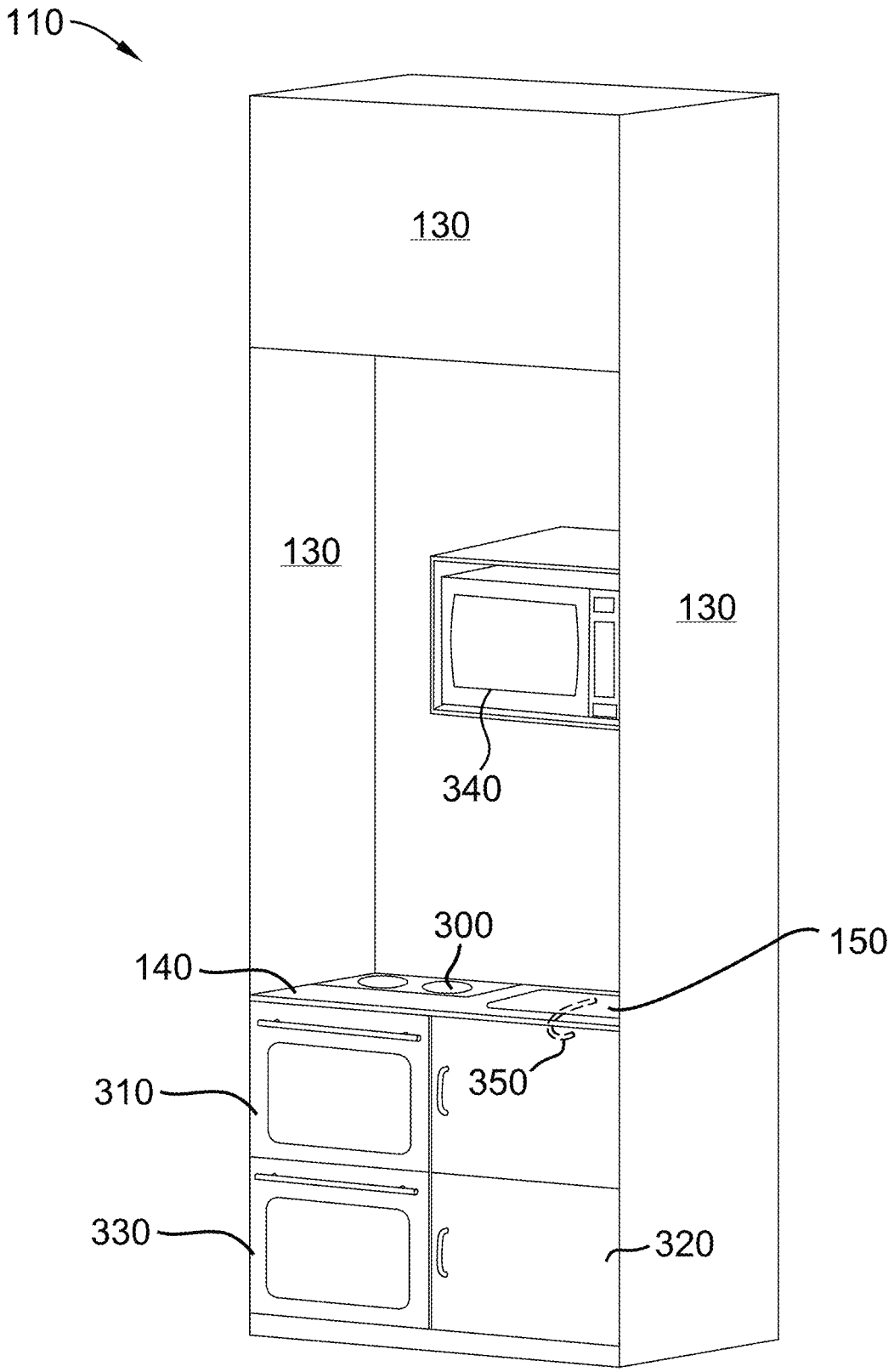
FIG. 3 depicts one embodiment of the first housing of the reconfigurable workspace.

FIG. 3 depicts one embodiment of the first housing 110 of the reconfigurable workspace 100. The first housing 110 comprises a plurality of walls 130 and an interior volume. In a preferred embodiment, the plurality of walls 130 of the first housing 110 are arranged in a rectangular prismatic configuration. In a preferred embodiment, a front side of the first housing 110 has no wall 130, leaving the front open to provide access to the interior. In one embodiment, a back side of the first housing 110 also has no wall 130. In this embodiment, a front wall of the second housing 120 may act as the back wall of the first housing 110. The interior volume of the first housing 110 comprises dimensions such that a width and depth are accessible at a standard arm's length. In one embodiment, width and depth dimensions of the first housing 110 measure between approximately two feet (0.61 meters) and six feet (1.22 meters). Preferably, the interior volume of the first housing 110 measures approximately four feet (1.22 meters) wide and two feet (0.61 meters) deep. In one embodiment, the first housing 110 measures approximately fourteen feet (4.27 meters) in height, though in other embodiments, the first housing 110 may be shorter or taller than fourteen feet (4.27 meters). The interior volume of the first housing 110 further comprises a counter space 140 and a sink 150. In a preferred embodiment, the counter space 140 is mounted within the first housing 110 between two opposite walls 130 at a convenient height to serve as a work surface. In a preferred embodiment, the counter space 140 comprises Corian. The sink 150 is mounted into the counter space 140. In one embodiment, the sink 150 is removably covered by the counter space 140. In one embodiment, a piece of the counter space 140 that extends over the sink 150 is cut out in the shape of the sink 150 and hinged so as to function as a removable sink cover. In this embodiment, a faucet 350 of the sink 150 may be folded down underneath the sink cover, or it may be embedded within the sink cover. In a preferred embodiment, the sink 150 is that which is described in patent specification No. U.S. Ser. No. 15/296,348, Sink System with Faucet in Sink Cover, which is commonly owned by the Applicant and incorporated by reference for all that it teaches. In one embodiment, the interior volume of the first housing 110 further comprises one or more appliances selected from a group consisting of a stove top 300, an oven 310, a refrigerator, 320, a dishwasher 330, and a microwave 340. In one embodiment, the first housing 110 is reversible. This means that the counter space 140 and the sink 150 of the first housing 110 may be accessed and utilized from both front and back sides of the first housing 110. In this embodiment, a front side and a back side of the first housing 110 have no wall 130, but are open, which allows access to the counter space 140 and the sink 150 from the two opposite sides of the first housing 110. In one embodiment, the sink 150 comprises a faucet 350 located between the sink 150 and an adjacent side wall 130 (the faucet 350 is to the side, rather than the front of back of the sink 150) of the first housing 110. This allows the sink 150 to be accessed and utilized from both front and back sides of the first housing 110.

Figure 4A:
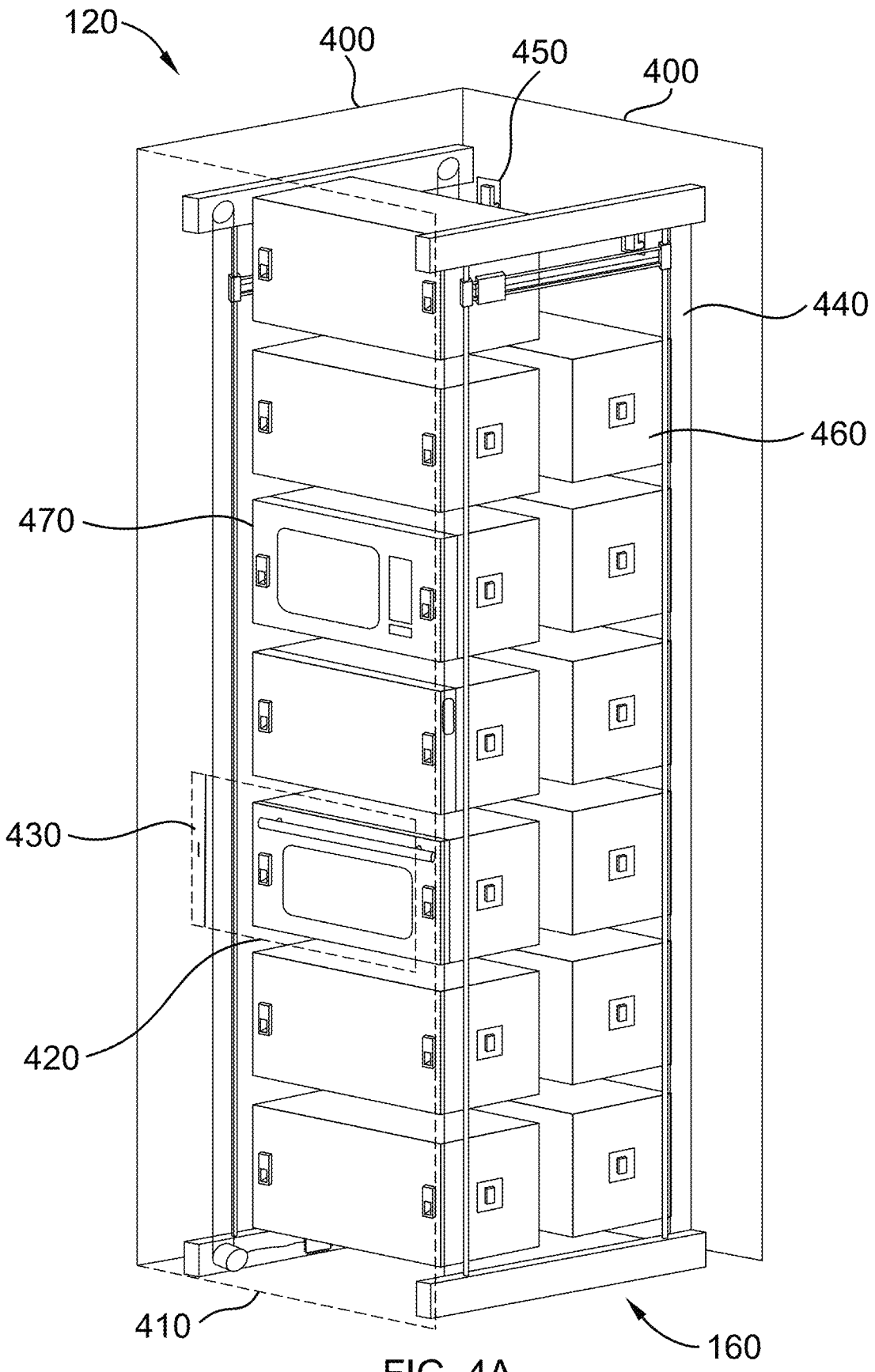
FIG. 4A depicts one embodiment of the second housing of the reconfigurable workspace comprising a non-revolving automated storage and retrieval system.
Figure 4B:
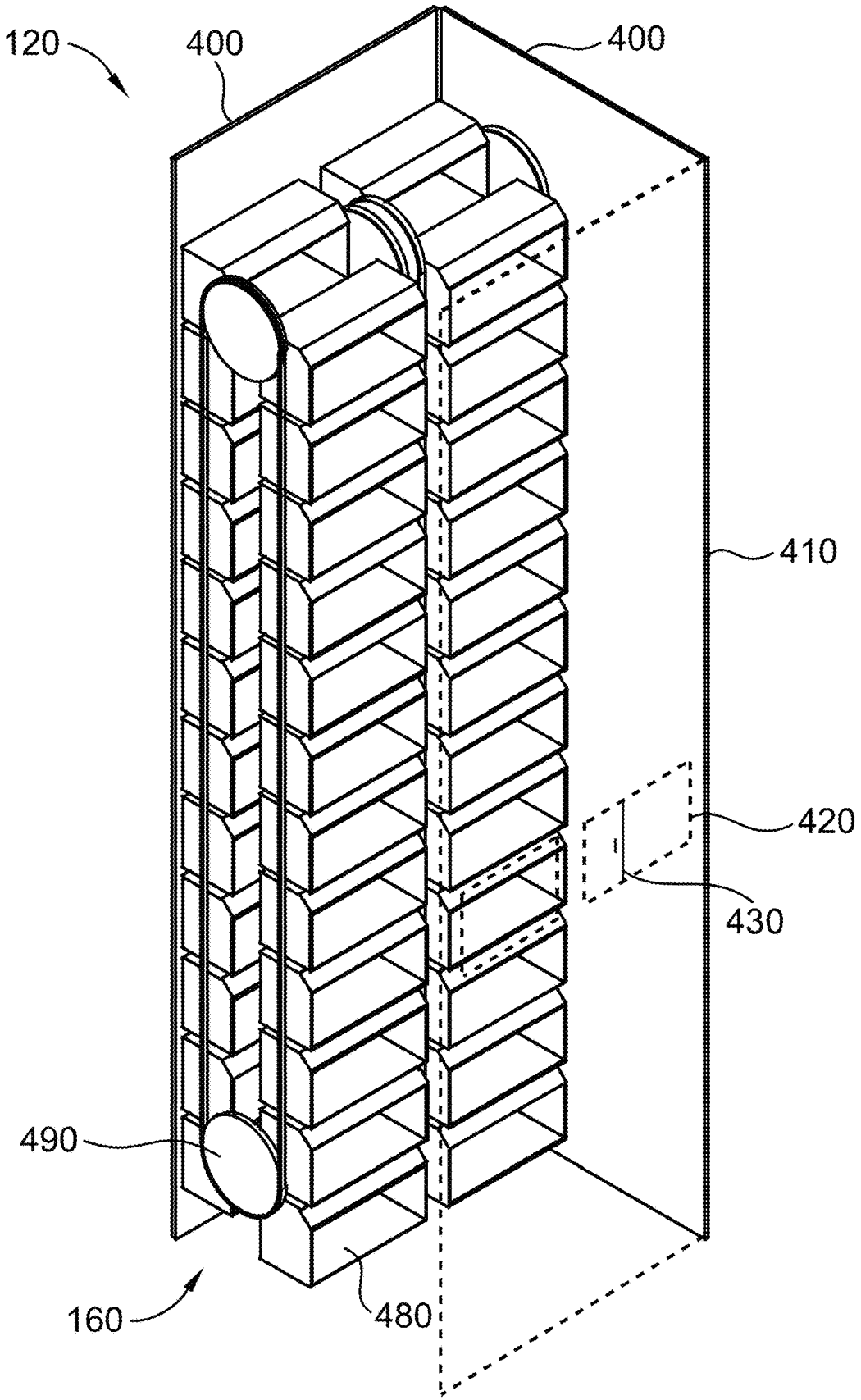
FIG. 4B depicts one embodiment of the second housing of the reconfigurable workspace comprising a revolving automated storage and retrieval system.

FIG. 4A and FIG. 4B depict embodiments of the second housing 120 of the reconfigurable workspace 100. The second housing 120 is disposed behind the first housing 110. In one embodiment, width and depth dimensions of the second housing 120 measure between approximately two feet (0.61 meters) and six feet (1.22 meters), preferably measuring approximately four feet (1.22 meters) wide and two feet (0.61 meters) deep. In one embodiment, the second housing 120 measures approximately fourteen feet (4.27 meters) in height. In other embodiments, the second housing 120 is shorter or taller than fourteen feet (4.27 meters). In a preferred embodiment, the first housing 110 and the second housing 120 are identical in shape and size. In a preferred embodiment, the second housing 120 comprises a rectangular configuration with a plurality of walls 400 (one side wall is not show in FIG. 4A and FIG. 4B so that the interior is visible). In a preferred embodiment, a front wall 410 comprises one or more access ports 420. Each access port 420 comprises a window that provides access to the interior of the second housing 120 and to the circulating storage system 160 inside. In a preferred embodiment, each access port 420 is located at a height that is also accessible at a standard arm's length from a person standing at ground level in a fixed position in front of the reconfigurable workspace 100, the access port 420 preferably just above the counter space 140 and the sink 150. In one embodiment, each access port 420 comprises a removable covering 430, the removable covering 430 comprising one of a group consisting of a flap that opens from the top or the bottom, a sliding panel, a curtain, or a blind. In one embodiment, the removable covering 430 is mechanically driven. The second housing 120 comprises a circulating storage system 160. In one embodiment, the circulating storage system 160 comprises electrically conductive wall hooks, as depicted and explained below in reference to FIG. 4A. In one embodiment, the circulating storage system 160 further comprises one or more appliances selected from the group consisting of microwaves, refrigerators, ice machines, heaters, toasters, mixers, ovens, juicers, dryers, grinders, dispensers, freezers, gas and electric cook tops, gas and electric ranges, bread machines, humidifiers, and grills, also depicted and explained below in reference to FIG. 4A. In a preferred embodiment, the circulating storage system 160 comprises an automated storage and retrieval system. An automated storage and retrieval system allows a user to select a desired item or set of items and instruct that the items be brought by mechanical means from distant storage areas to a convenient access point. Thus, an automated storage and retrieval system provides a convenient method for locating and accessing goods while utilizing limited space to full capacity, which, in this case, is desirable in that it allows all areas of the second housing 120 to be utilized and conveniently accessed, even when the second housing 120 is disposed behind the first housing 110.

In one embodiment, the circulating storage system 160 is a non-revolving automated storage and retrieval system, as depicted in FIG. 4A. In some embodiments, the non-revolving automated storage and retrieval system is that which is described in Automatic Storage and Retrieval System with Planar Motion Mechanism, patent specification No. U.S. Ser. No. 15/248,589; Automated Storage and Retrieval Direct Movement Method, patent specification No. U.S. Ser. No. 15/260,979; or Automated Storage and Retrieval System with Retractable Mountings, patent specification No. U.S. Ser. No. 15/278,545, which are commonly owned by the Applicant and incorporated by reference for all that they teach. In one embodiment, the non-revolving storage and retrieval system comprises one or more planar motion mechanisms 440 movably mounted to the plurality of walls 400 of the second housing 120, the one or more planar motion mechanisms 440 preferably being H-bots. In one embodiment, the non-revolving storage and retrieval system further comprises one or more connectors 450 mounted to the plurality of walls 400 of the second housing 120. In one embodiment, the connectors 450 in the non-revolving automated storage and retrieval system are electrically conductive wall hooks. In one embodiment, the electrically conductive wall hooks are those which are described in patent specification No. U.S. Ser. No. 15/277,090, Electrically Conductive Wall Hooks, which is commonly owned by the Applicant and incorporated by reference for all that it teaches. Suspended from the connectors 450 are one or more positionable objects 460—preferably one positionable object 460 being suspended from each set of two connectors 450. The one or more positionable objects 460 may be stacked in two or more columns. In one embodiment, the one or more positionable objects 460 are storage bins. In other embodiments, the one or more positionable objects 460 are one or more appliances 470, preferably appliances as described in Modular Domestic Appliance with Electrically Conductive Members, patent specification No. 15286877, which is commonly owned by the Applicant and incorporated by reference for all that it teaches. In one embodiment, each appliance 470 is selected from the group consisting of microwaves, refrigerators, ice machines, heaters, toasters, mixers, ovens, juicers, dryers, grinders, dispensers, freezers, gas and electric cook tops, gas and electric ranges, bread machines, humidifiers, and grills. In one embodiment, the one or more planar motion mechanisms 440 suspend the positionable objects 460, including any appliances 470, from the one or more connectors 450, repositioning the positionable objects 460 in a non-revolving pattern within the second housing 120 until a desired positionable object 460 reaches an access port 420, where it can be accessed and utilized. The one or more positionable objects 460 that are suspended by conductors 450 that are electrically conductive wall hooks are supplied with electrical power. In particular, those positionable objects 460 that are appliances 470 and suspended from electrically conductive wall hooks are supplied with the necessary power for operation. This allows the one or more appliances 470 to be placed within the automated storage and retrieval system and powered while circulating therein, rather than being placed of necessity in the first housing 110 to receive the necessary power for operation. This leaves more space available in the first housing 110 for workspace. In one embodiment, the non-revolving automated storage and retrieval system comprises a microcontroller that stores location data for each positionable object 460 and instructs the one or more planar motion mechanisms 440 to reposition the positionable objects 460 based on the location data in response to a request by a user. In some embodiments, a user makes requests by means of a user interface, which may be voice controlled, and which may allow customized inputs.

In one embodiment, the circulating storage system 160 is a revolving automated storage and retrieval system, as depicted in FIG. 4B. In one embodiment, the revolving automated storage and retrieval system may comprise items 480 revolving on a carousel 490. In other embodiments, the items 480 may revolve by means of tracks, lifting mechanisms, or rams. In each embodiment, items 480 are moved in a revolving pattern to bring a desired item 480 to an access port 420. The items 480 are rotated in a clockwise or a counterclockwise direction depending on which direction will bring the desired item 480 to the access port 420 in a shorter length of time. In some embodiments, a user requests a desired item 480 or controls movement of the items 480, both the direction and duration of movement, via a user interface. For example, in one embodiment, a user interface comprises two buttons. Pressing a first button causes the automated storage and retrieval system to revolve in a clockwise direction until the first button is released. Pressing a second button causes the automated storage and retrieval system to revolve in a clockwise direction until the second button is released. A user presses the buttons to bring a desired item 480 to the access port 420. In other embodiments, the user interface is voice controlled.

The first housing 110 and the second housing 120 are repositionable in relation to each other along a fixed path. FIG. 5A-FIG. 7C depict embodiments of the first housing 110 and the second housing 120 being repositioned in relation to each other along a fixed path. The fixed path comprises an apparatus 170 that repositions the first housing 110 and the second housing 120. In one embodiment, the apparatus 170 comprises a set of tracks mounted to one or more walls. In another embodiment, the apparatus 170 comprises a set of tracks in a floor. In still another embodiment, the apparatus 170 comprises a hinge. In each embodiment, the apparatus 170 repositions the first housing 110 and the second housing 120, but limits the movement of each housing to the fixed path.

Figure 5A:
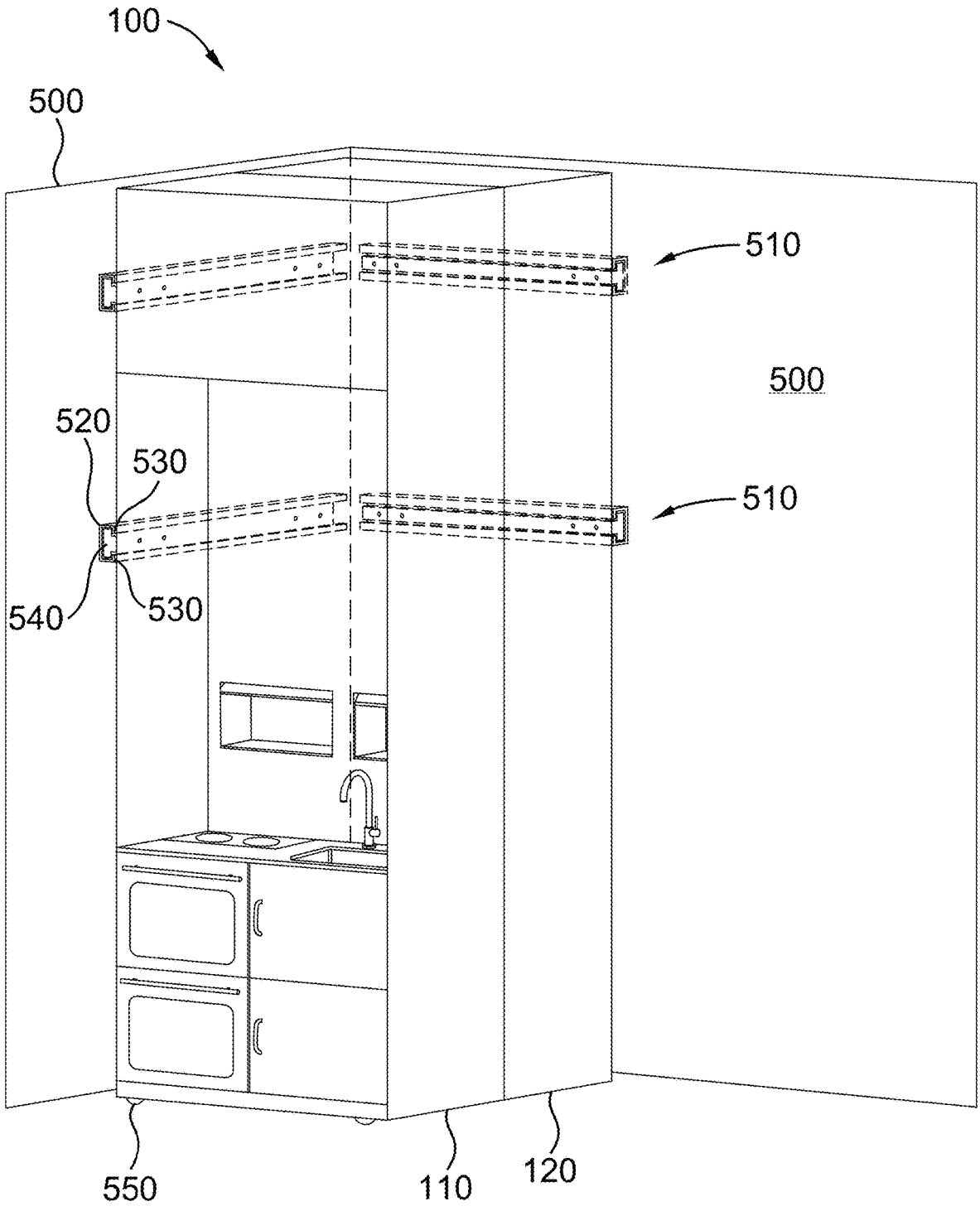
FIG. 5A depicts one embodiment of the reconfigurable workspace fitted with a set of tracks mounted to one or more walls.
Figure 5C:
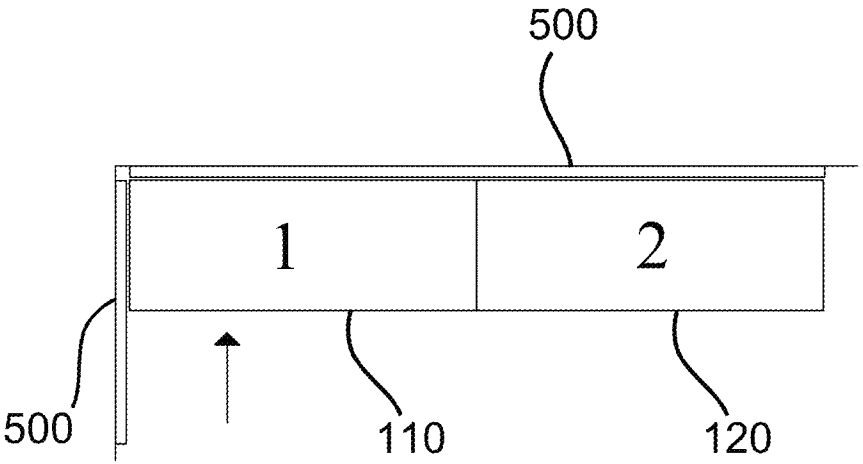
FIG. 5C depicts a top view of one embodiment of a second step of the first housing and the second housing being repositioned by means of the set of tracks.
Figure 5B:
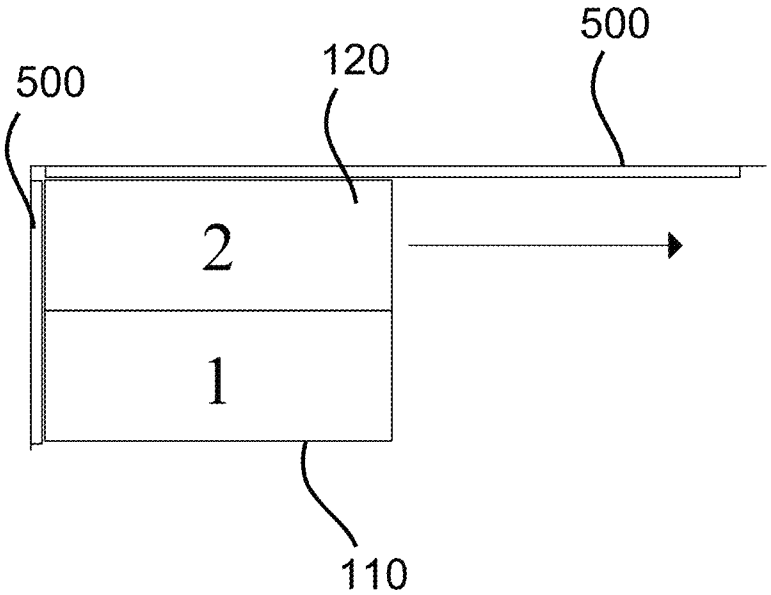
FIG. 5B depicts a top view of one embodiment of a first step of the first housing and the second housing being repositioned by means of the set of tracks.

FIG. 5A-FIG. 5C depict one embodiment of the first housing 110 and the second housing 120 being repositioned in relation to each other by means of a set of tracks 510 mounted to one or more walls 500. In one embodiment, each track 510 comprises a metal carrying channel 520 with flanges 530 on two opposite sides. The metal carrying channel 520 is mounted to the one or more walls 500 adjacent to which the reconfigurable workspace 100 will be located. Inside the metal carrying channel 520 is a metal runner 540, dimensioned so as to fit inside the carrying channel 520 and to slide in and out. The metal runner 540 is mounted to either the first housing 110 or the second housing 120, such that when the metal runner 540 is slid into or out of the carrying channel 520, the first housing 110 or the second housing 120 can be moved forward or backward or side to side. The first housing 110 or the second housing 120 may be fitted with wheels 550 on the bottom for easier forward or backward or side to side movement. In a preferred embodiment, the first housing 110 is fitted with one or more tracks 510 that allow it to move forward or backward, and the second housing 120 is fitted with one or more tracks 510 that allow it to move from side to side. FIG. 5A depicts one embodiment of the reconfigurable workspace 100 fitted with a set of tracks 510 mounted to one or more walls 500. FIG. 5B depicts a top view of one embodiment of a first step of the first housing 110 and the second housing 120 being repositioned by means of the set of tracks 510. At first, the second housing 120 is disposed behind the first housing 110. Then, the metal runner 540 mounted to the second housing 120 is slid sideways along the carrying channel 520 such that the second housing 120 moves horizontally to a position adjacent to its previous position. FIG. 5C depicts a top view of one embodiment of a second step of the first housing 110 and the second housing 120 being repositioned by means of the set of tracks 520. In this step, the metal runner 540 mounted to the first housing 110 is slid along the carrying channel 520 such that the first housing 110 moves backwards until it occupies the exact position that was previously occupied by the second housing 120. At this point, the first housing 110 and the second housing 120 are positioned horizontally side by side, such that the front of each housing is fully accessible to a user. Other embodiments comprise different movement configurations.

Figure 6A:
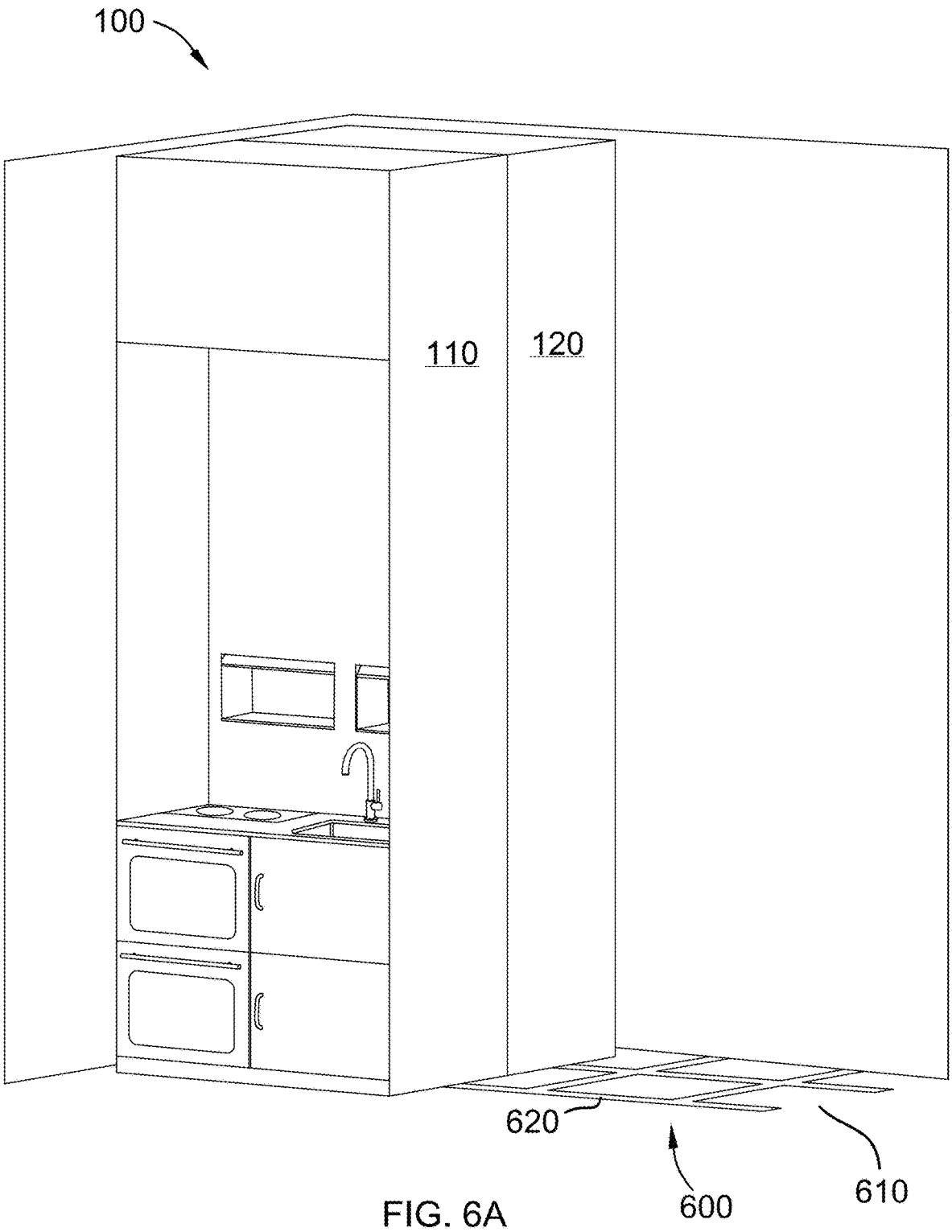
FIG. 6A depicts one embodiment of the reconfigurable workspace fitted with a set of tracks in a floor.
Figure 6C:
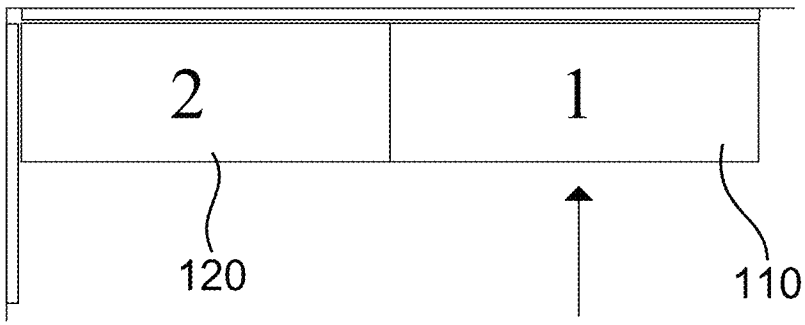
FIG. 6C depicts a top view of one embodiment of a second step of the first housing and the second housing being repositioned by means of the set of tracks.
Figure 6B:
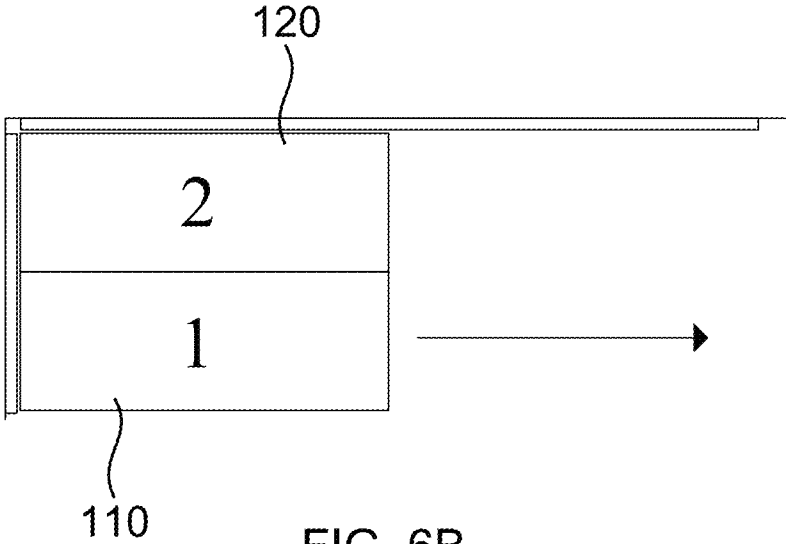
FIG. 6B depicts a top view of one embodiment of a first step of the first housing and the second housing being repositioned by means of the set of tracks.

FIG. 6A-FIG. 6C depict one embodiment of the first housing 110 and the second housing 120 being repositioned in relation to each other by means of a set of tracks 600 in a floor 610. In one embodiment, each track 600 comprises a metal groove 620 in the floor 610. In another embodiment, each track 600 comprises one or more metal flanges protruding up from the floor 610, with a groove in between. In one embodiment, the bottom peripheries of the first housing 110 and the second housing 120 are configured to mate the with set of tracks 600 in the floor 610. In one embodiment, the bottom peripheries of the first housing 110 and the second housing 120 comprise protruding metal flanges dimensioned to fit within the set of tracks 600 in the floor 610. In another embodiment, the bottom peripheries of the first housing 110 and the second housing 120 are fitted with wheels or pins that fit within the set of tracks 600 in the floor 610. The bottom peripheries of the first housing 110 and the second housing 120 are slid along the set of tracks 600, whether forward or backward, side to side, in a circle, or in another pattern. Because the set of tracks 600 are in the floor 610, the reconfigurable workspace 100 can be positioned at any place within a room—it is not necessary that the reconfigurable workspace 100 be positioned adjacent to a wall. In a preferred embodiment, a set of tracks 600 is positioned on each of two adjacent sides of the first housing 110 such that the first housing 110 can be moved forward and backward and horizontally side to side, and a second set of tracks 600 is positioned on each of two adjacent sides of the second housing 120 such that the second housing 120 is able to move forward and backward and horizontally side to side. FIG. 6A depicts one embodiment of the reconfigurable workspace 100 fitted with a set of tracks 600 in a floor 610. FIG. 6B depicts a top view of one embodiment of a first step of the first housing 110 and the second housing 120 being repositioned by means of the set of tracks 600. At first, the second housing 120 is disposed behind the first housing 110. Then, the first housing 110 is slid sideways along the set of tracks 600 such that it moves horizontally to a position adjacent to its previous position. FIG. 6C depicts a top view of one embodiment of a second step of the first housing 110 and the second housing 120 being repositioned by means of the set of tracks 600. In the second step, the first housing 110 is slid backward along the set of tracks 600 such that the first housing 110 occupies a position horizontally adjacent to the second housing 120, which has not moved. At this point, the first housing 110 and the second housing 120 are positioned horizontally side by side, such that the front of each housing is fully accessible to a user. In other embodiments, numerous other patterns of movement along the set of tracks 600 in the floor 610 are possible.

Figure 7A:
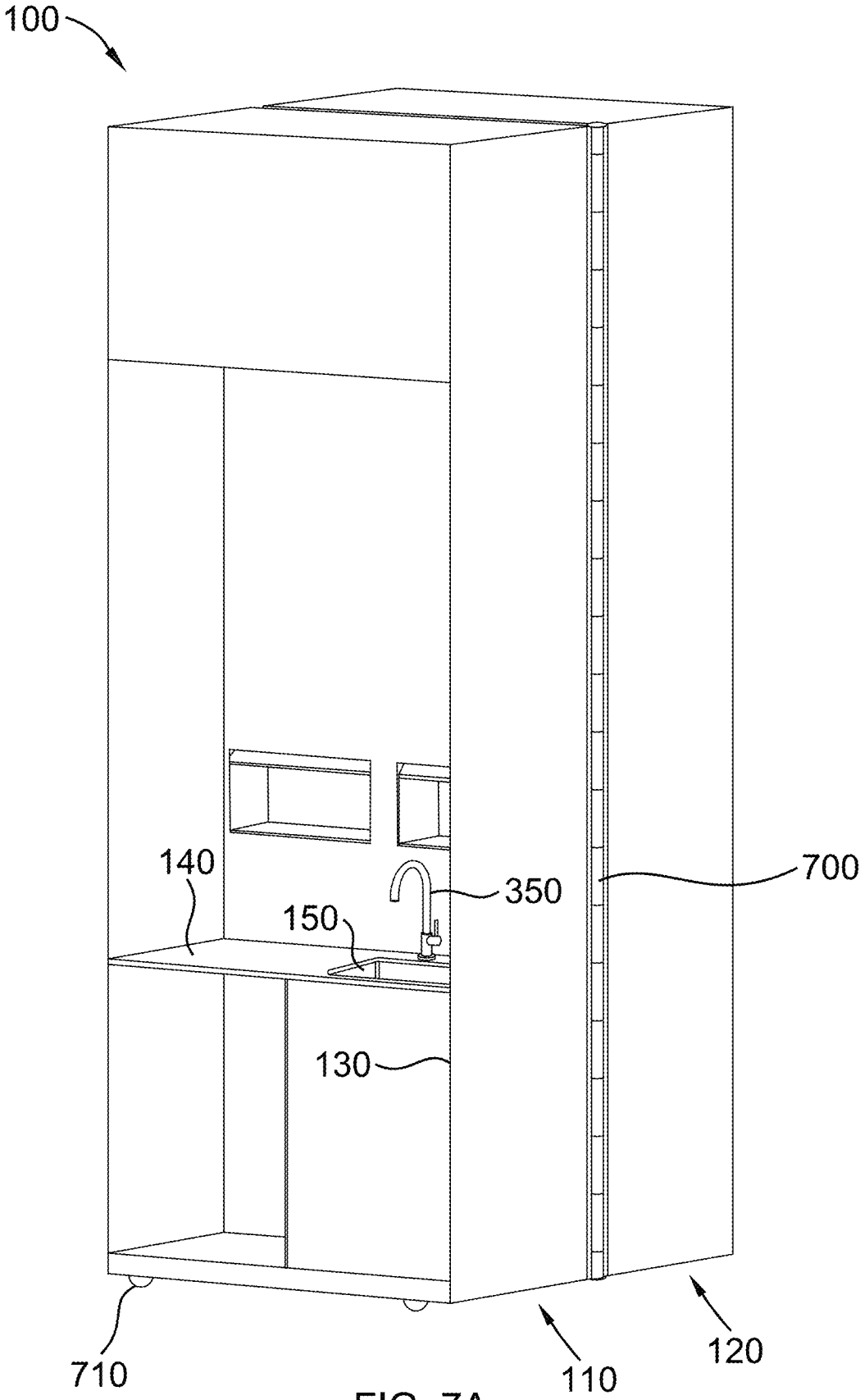
FIG. 7A depicts one embodiment of the reconfigurable workspace fitted with one or more hinges.
Figure 7C:
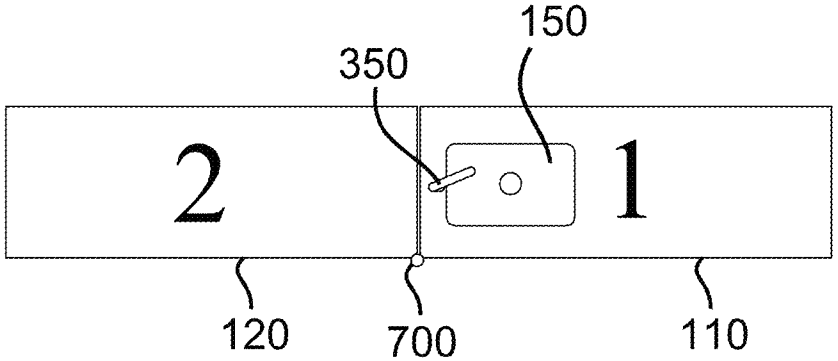
FIG. 7C depicts a top view of one embodiment of the resulting position of the first housing and the second housing.
Figure 7B:
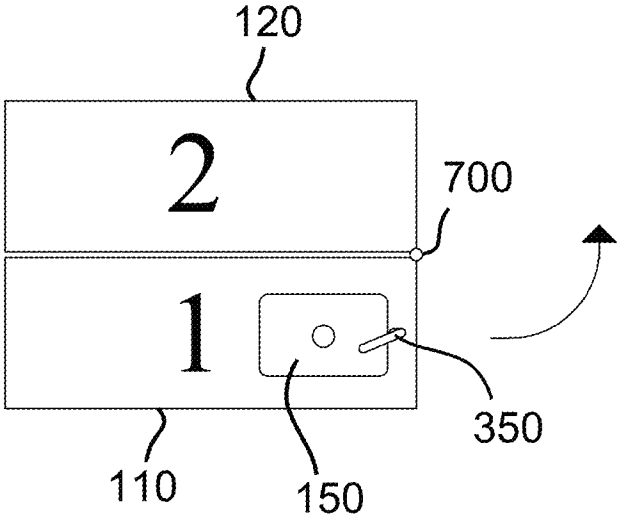
FIG. 7B depicts a top view of one embodiment of the first housing and the second housing being repositioned by means of the one or more hinges.

FIG. 7A-FIG. 7C depict one embodiment of the first housing 110 and the second housing 120 being repositioned in relation to each other by means of one or more hinges 700. In this embodiment, the first housing 110 is joined to the second housing 120 by means of one or more hinges 700. In one embodiment, only one hinge 700 connects the first housing 110 and the second housing 120. In another embodiment, more than one hinge 700 connects the first housing 110 and the second housing 120. FIG. 7A depicts one embodiment of the reconfigurable workspace 100 fitted with one or more hinges 700. FIG. 7B depicts a top view of one embodiment of the first housing 110 and the second housing 120 being repositioned by means of the one or more hinges 700. At first, the second housing 120 is disposed behind the first housing 110. Then, the first housing 110 is able to move from a first position directly in front of the second housing 120 to a second position horizontally adjacent to the second housing 120 by rotating around the one or more hinges 700. FIG. 7C depicts a top view of one embodiment of the resulting position of the first housing 110 and the second housing 120. Moving from the first position to the second position via the one or more hinges causes the first housing 110 to rotate 180 degrees in relation to the second housing 120. Therefore, in one embodiment, the first housing 110 is reversible. This means that the counter space 140 and the sink 150 of the first housing 110 may be accessed and utilized from both front and back sides of the first housing 110. In this embodiment, a front side and a back side of the first housing 110 have no wall 130, but are open, which allows access to the counter space 140 and the sink 150 from the two opposite sides of the first housing 110. In one embodiment, the sink 150 comprises a faucet 350 located between the sink 150 and an adjacent side wall 130 (the faucet 350 is to the side, rather than the front of back of the sink 150) of the first housing 110. This allows the sink 150 to be accessed from both front and back sides of the first housing 110. In one embodiment, the first housing 110 is suspended from the ground by the one or more hinges to allow for easier movement of the first housing 110. In another embodiment, the first housing 110 comprises wheels 710 beneath the first housing to allow for easier movement.

Figure 8A:
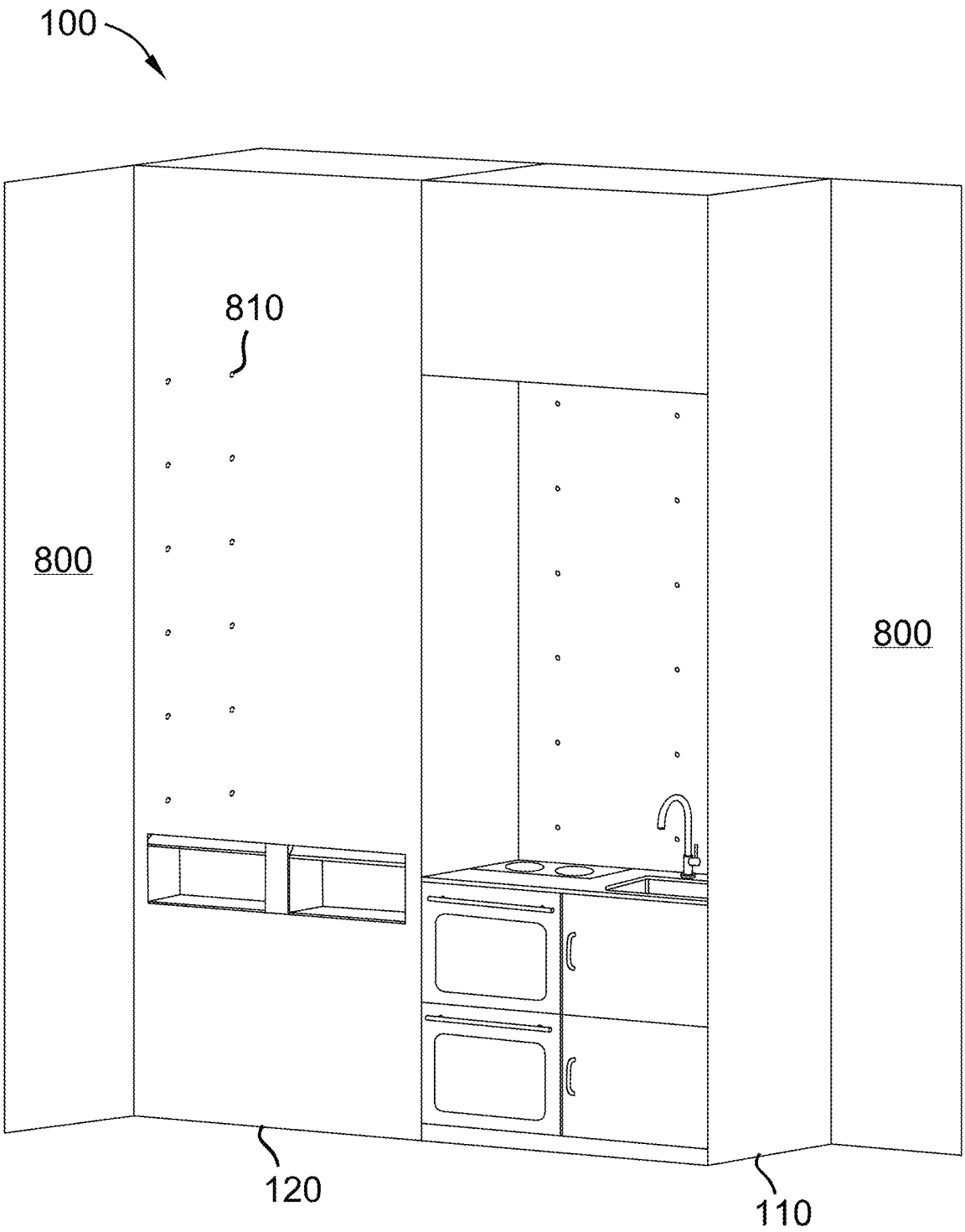
FIG. 8A depicts one embodiment of the reconfigurable workspace mounted to one or more walls.

FIG. 8A depicts one embodiment of the reconfigurable workspace 100 mounted to one or more walls 800. In this embodiment, the first housing 110 and the second housing 120 each have the ability to be mounted to one or more walls 800 by means of fasteners 810. The fasteners 810 are any of a variety of off-the-shelf bolts, screws, rivets, pins, anchors, brackets, or adhesives. This allows a user to choose a configuration for the first housing 110 and the second housing 120 and fix it in place in a more permanent and secure manner. In one embodiment, the first housing and the second housing 120 are mounted in a position wherein the second housing 120 is disposed behind the first housing 110. In another embodiment, the first housing 110 and the second housing 120 are mounted in a position such that they are horizontally adjacent to each other, as depicted in FIG. 8A. The first housing 110 and the second housing 120 can still be moved once mounted to the one or more walls 800, but this requires a longer and more difficult process than in non-mounted embodiments. However, mounting the reconfigurable workspace 100 to one or more walls 800 provides more stability.

Figure 8B:
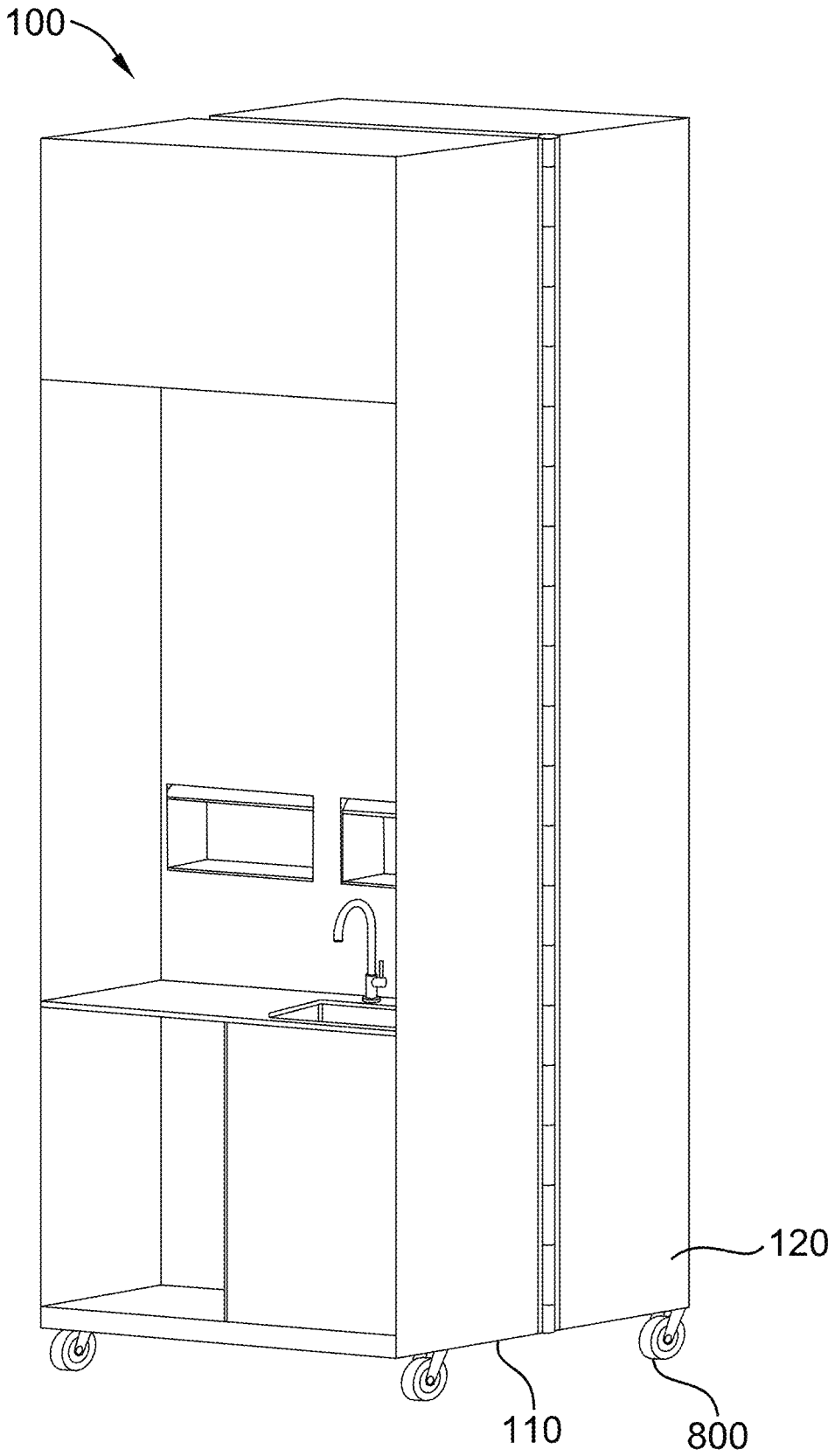
FIG. 8B depicts one embodiment of a reconfigurable workspace that is portable.

FIG. 8B depicts one embodiment of a reconfigurable workspace 100 that is portable. In this embodiment, the reconfigurable workspace 100 can be easily transported from one location to a new location. Any connections to plumbing or utilities must be disconnected and reconnected in the new location. In one embodiment, the reconfigurable workspace 100 is transported by means of wheels 800 positioned beneath the reconfigurable workspace 100. In a preferred embodiment, the first housing 110 and the second housing 120 of a portable reconfigurable workspace 100 are joined together by one or more hinges 700.

Figure 9B:
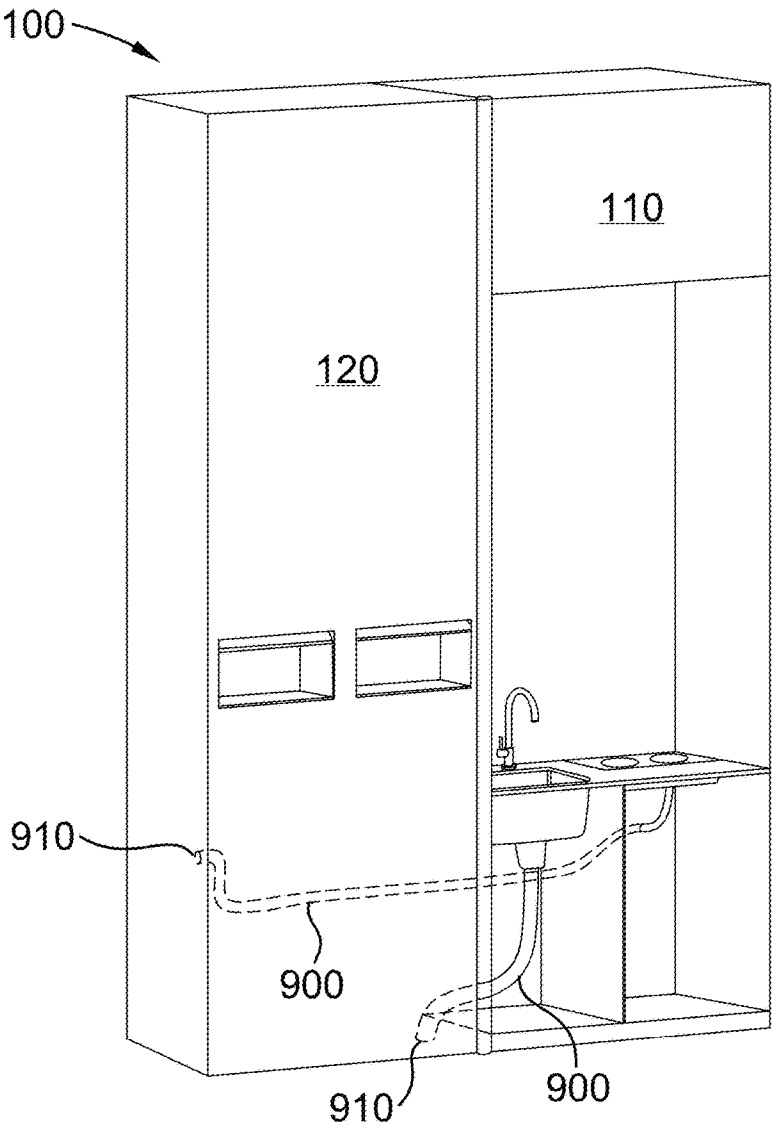
FIG. 9B depicts one embodiment of the flexible piping providing plumbing and utilities to the reconfigurable workspace in a configuration where the first housing and the second housing are positioned horizontally adjacent to each other.
Figure 9A:
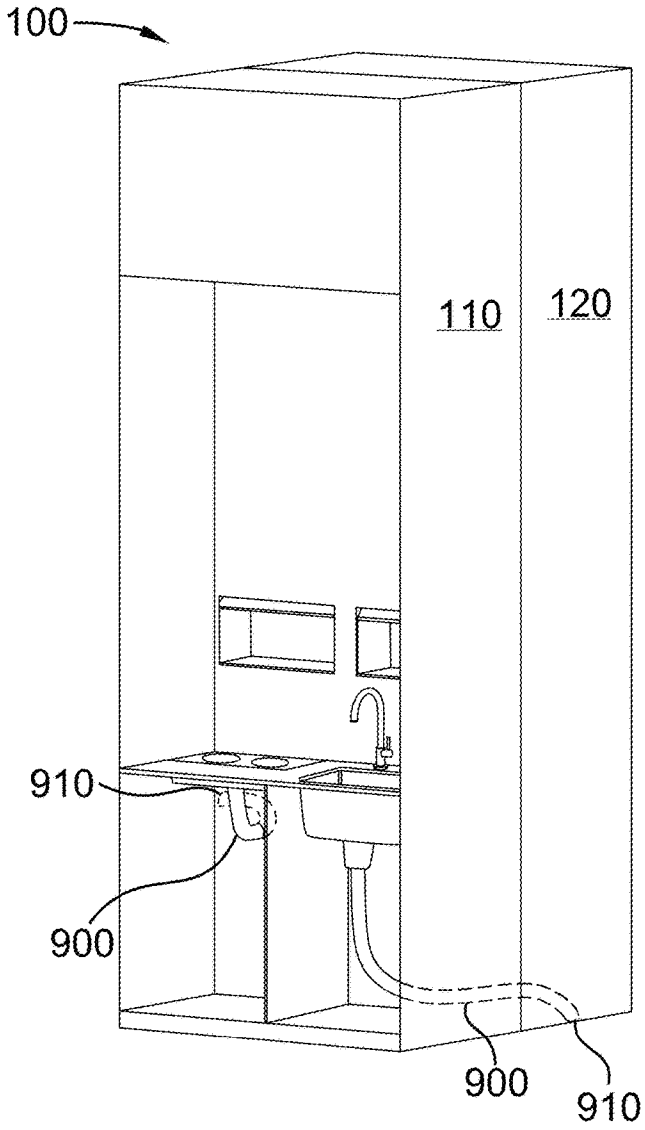
FIG. 9A depicts one embodiment of flexible piping providing plumbing and utilities to the reconfigurable workspace when the second housing is disposed behind the first housing.

FIG. 9A-FIG. 9B depict embodiments of the reconfigurable workspace 100 wherein utilities and plumbing are provided for by flexible piping 900. One difficulty with being able to reconfigure or transport a workspace that comprises a sink, and that potentially comprises a stove top, oven, or other appliances as well, is that the connections to utilities and plumbing also need to be capable of easy transportation or reconfiguration. The flexible piping 900 allows the first housing 110 and the second housing 120 to be easily moved in relation to sources of plumbing and utilities. As the first housing 110 and the second housing 120 move, the flexible piping 900 bends, retracts, or extends in order to continue to supply the reconfigurable workspace 100 with plumbing and utilities at the new positions of the first housing 110 or the second housing 120. In one embodiment, the flexible piping 900 is arranged in a helical shape and extends and retracts similar to a spring. Another embodiment comprises a pipe and conduit assembly in which the pipe and conduit are divided into segments and the segments extend and retract in a telescoping manner. In some embodiments, numerous connection points 910 can be made available in floors or wall for gas lines, water supply lines, drain pipes, etc. so that the flexible piping 900 can be reattached at a new connection point 910 when the first housing 110 or the second housing 120 has moved to a new position in order to provide utilities or plumbing. FIG. 9A depicts one embodiment of the flexible piping 900 providing plumbing and utilities to the reconfigurable workspace 100 when the second housing 120 is disposed behind the first housing 110. FIG. 9B depicts one embodiment of the flexible piping 900 providing plumbing and utilities to the reconfigurable workspace 100 in a configuration where the first housing 110 and the second housing 120 are positioned horizontally adjacent to each other.

The invention claimed is:

1. A reconfigurable workspace comprising:

a first housing comprising a plurality of walls arranged in a box configuration;

a compact kitchen inside the first housing, the compact kitchen comprising a counter, one or more kitchen appliances, and a sink;

a second housing adjoining and contiguous to the first housing; and an automated storage and retrieval system within the second housing, the automated storage and retrieval system comprising a plurality of repositionable storage bins that, when a user selects one of the repositionable storage bins, circulate automatically to move the selected one of the repositionable storage bins to a user access port, wherein the counter, one or more kitchen appliances, sink, and user access port are simultaneously accessible by the user at a single location, wherein the first and second housings are repositionable in relation to each other along a fixed path, the fixed path comprising an apparatus that repositions the first and second housings; and wherein the automated storage and retrieval system comprises electrically conductive wall hooks from which the repositionable storage bins are suspended.

2. The reconfigurable workspace of claim 1, wherein width and depth dimensions of the first housing measure between approximately two feet (0.61 meters) and six feet (1.2192 meters).

3. The reconfigurable workspace of claim 1, wherein width and depth dimensions of the second housing measure between approximately two feet (0.61 meters) and six feet (1.2192 meters).

4. The reconfigurable workspace of claim 1, wherein the first housing measures approximately four feet (1.2192 meters) wide and two feet (0.61 meters) deep.

5. The reconfigurable workspace of claim 1, wherein the second housing measures approximately four feet (1.2192 meters) wide and two feet (0.61 meters) deep.

6. The reconfigurable workspace of claim 1, wherein the first housing and the second housing are identical in shape and size.

7. The reconfigurable workspace of claim 1, wherein the one or more kitchen appliances are selected from a group consisting of a stove top, an oven, a refrigerator, a dishwasher, and a microwave.

8. The reconfigurable workspace of claim 1, wherein the storage bins reposition by revolving.

9. The reconfigurable workspace of claim 1, wherein the storage bins reposition in a non-revolving manner.

10. The reconfigurable workspace of claim 1, wherein the automated storage and retrieval system comprises one or more electrical appliances selected from a group consisting of microwaves, refrigerators, ice machines, heaters, toasters, mixers, ovens, juicers, dryers, grinders, dispensers, freezers, gas and electric cook tops, gas and electric ranges, bread machines, humidifiers, and grills.

11. A reconfigurable workspace comprising:

a first housing comprising a plurality of walls arranged in a box configuration;

a compact kitchen inside the first housing, the compact kitchen comprising a counter, one or more kitchen appliances, and a sink;

a second housing adjoining and contiguous to the first housing; and an automated storage and retrieval system within the second housing, the automated storage and retrieval system comprising a plurality of repositionable storage bins that, when a user selects one of the repositionable storage bins, circulate automatically to move the selected one of the repositionable storage bins to a user access port, wherein the counter, one or more kitchen appliances, sink, and user access port are simultaneously accessible by the user at a single location, wherein the first and second housings are repositionable in relation to each other along a fixed path, the fixed path comprising an apparatus that repositions the first and second housings; and wherein the apparatus comprises a set of tracks mounted to one or more remote walls.

12. The reconfigurable workspace of claim 1, wherein the apparatus comprises a set of tracks in a floor.

13. The reconfigurable workspace of claim 1, wherein the apparatus comprises one or more hinges.

14. The reconfigurable workspace of claim 1, wherein the first housing is reversible in relation to the second housing.

15. The reconfigurable workspace of claim 1, wherein the reconfigurable workspace is mounted to one or more remote walls.

16. The reconfigurable workspace of claim 1, wherein the reconfigurable workspace is portable.

17. The reconfigurable workspace of claim 1, wherein the sink is removably covered by the counter.

18. The reconfigurable workspace of claim 1, wherein utilities and plumbing are provided for by flexible piping.

* * * * *